United States Patent [19]

Hildebrandt

[11] Patent Number: 4,962,853

[45] Date of Patent: Oct. 16, 1990

[54] MULTI-COMPARTMENT CONTAINER FOR POURABLE SUBSTANCES

[75] Inventor: Bodo Hildebrandt, Riedstadt, Fed. Rep. of Germany

[73] Assignee: Wella Aktiengesellschaft, Darmstadt, Fed. Rep. of Germany

[21] Appl. No.: 327,919

[22] PCT Filed: Apr. 22, 1988

[86] PCT No.: PCT/EP88/00344

§ 371 Date: Jan. 20, 1989

§ 102(e) Date: Jan. 20, 1989

[87] PCT Pub. No.: WO88/09297

PCT Pub. Date: Dec. 1, 1988

[30] Foreign Application Priority Data

May 20, 1987 [DE] Fed. Rep. of Germany ..... 8707230

[51] Int. Cl.[5] ..... B65D 23/04

[52] U.S. Cl. ..... 206/222; 215/DIG. 8

[58] Field of Search ..... 206/222, 220, 219; 215/DIG. 8, 6; 401/40, 41

[56] References Cited

U.S. PATENT DOCUMENTS

| | | | |
|---|---|---|---|
| 4,247,001 | 1/1981 | Wiegner | 206/222 |
| 4,757,916 | 7/1988 | Goncalves | 206/222 X |
| 4,781,484 | 11/1988 | Goncalves | 401/40 X |
| 4,801,009 | 1/1989 | Amos | 206/222 |

FOREIGN PATENT DOCUMENTS

| | | |
|---|---|---|
| 2929635 | 6/1976 | France . |
| 2590235 | 5/1987 | France . |

*Primary Examiner*—Paul T. Sewell
*Assistant Examiner*—Jacob K. Ackun, Jr.
*Attorney, Agent, or Firm*—Michael J. Striker

[57] ABSTRACT

A multiple compartment container for pourable substances, particularly liquids, comprising first and second container portions, at least one foil for separating said first and second container portions, a severing device for severing the foil, a spindle for rotatably supporting the severing device, and a rotatable activating device connected with the severing device for joint rotation therewith.

12 Claims, 2 Drawing Sheets

MULTI-COMPARTMENT CONTAINER FOR POURABLE SUBSTANCES

FIELD OF THE INVENTION

The invention relates to a multiple-compartment container for pourable substances, particularly liquids, in which the interior spaces of a first and a second container portion are separated from one another by at least one foil, and a device is provided for severing the foil.

Containers for liquids and also other pourable substances such as powders and granules, which make it possible to preserve a plurality of substances separately and in which the substances can be mixed shortly before use are known.

BACKGROUND OF THE INVENTION

One of the known multiple-compartment containers (DE-GM 77 07 618) consists of two cells which are arranged one above the other and are connected with one another so as to be detachable, and which can be displaced relative to one another and are kept at a distance from one another in such a way that a foil separating their interior spaces from one another can be severed by reducing the distance between the cells. The distance can be reduced by rotation if the cells are provided with a thread according to a development of the known multiple-compartment container. However, this known multiple-compartment container is quite costly to produce.

Another known multiple-compartment container (EP-PS 0101 594) consists of a one-piece base container and a one-piece top container which are separated from one another by means of a separating foil. The base container is deformable a punching tool is provided therewhich is adapted to the cross section of the container and which penetrates the separating foil when the base container is deformed. In this known multiple-compartment container, a relatively high force is required for penetrating the separating foil.

SUMMARY OF THE INVENTION

The object of the invention is to provide a multiple-compartment container which can be produced at low cost and is simple to fill and easy to handle when mixing and applying the substances.

The multiple-compartment container according to the invention is characterized in that a spindle is provided in the first container portion, a device for severing being supported on the spindle so as to be rotatable, and a rotatable activating device is connected with the device for severing for joint rotation therewith.

The multiple-compartment container according to the invention is suitable for receiving various pourable substances. A preferred application consists in the packaging of hair dye compositions, wherein a peroxide solution is kept in the first container portion and a dyeing substance is kept in the second container portion.

A further development of the multiple-compartment container, according to the invention, consists in that the activating device and the severing device are axially displaceable relative to one another and in that the activating device is secured against axial displacement. Accordingly, the handling of the multiple-compartment container according to the invention is further improved.

Advantageous constructions of the multiple-compartment container according to the invention consist in that the activating device comprises an annular portion which partially encloses the first container portion and is constructed as an upright ring.

Additional advantageous constructions relate to a support and the connection of the activating device with the severing device. Thus, the activating device comprises a pivot which is supported in an axially extending bore of the spindle and its end which faces the interior space of the first container portion, is constructed as a driver for the severing device. It is advantageous that the pivot be provided with a circumferentially extending flange which, together with a circumferentially extending groove in the bore, forms an axial protection of the activating device.

At least one sealing ring can be provided at the spindle for sealing the interior space of the first container portion.

In order to achieve severing of the foil relatively brief rotation, it is provided, according to another development of the invention, that the spindle comprises a coarse thread.

Other developments concern advantageous constructions of the device for severing. Thus, it can be provided, for example, that the device for severing comprises a spindle nut and at least one arm which extends in the radial and axial directions and whose end remote from the spindle nut is constructed as a cutting edge. A plurality of arms can be provided which are connected with one another in a ring-shaped manner in the area of the cutting edges.

In order to improve the mixing process, the severing device can comprise devices for improving the mixing of the substances, particularly guide blades, according to another development.

Another advantageous construction of the multiple-compartment container, according to the invention, consists in that the container portions are closed by a foil at the surface facing the other respective container portion, in that one of the container portions comprises a circumferentially extending edge, and in that the other container portion is provided with a snap ring grasping the circumferentially extending edge. A simple joining of the container portions after they are filled is accordingly ensured on the one hand. On the other hand, a secure sealing of the containers relative to one another and from the outside results.

The pouring of the mixed substances is facilitated, according to another development, in that the first container portion can be creased.

Finally, an advantageous construction consists in that the second container portion comprises a pouring opening, and in that the inner wall of the second container portion is provided with ribs at least in the area of the pouring opening.

The invention as to its construction so to its method of operation, together with additional objects and advantages thereof, will be best understood from the following description of the preferred embodiments with reference to the accompanying drawings.

BRIEF DESCRIPTION OF DRAWINGS

In FIGS. 1 and 2 identical parts are provided with identical reference numerals.

DESCRIPTION OF THE PREFERRED EMBODIMENTS

Figure 1:
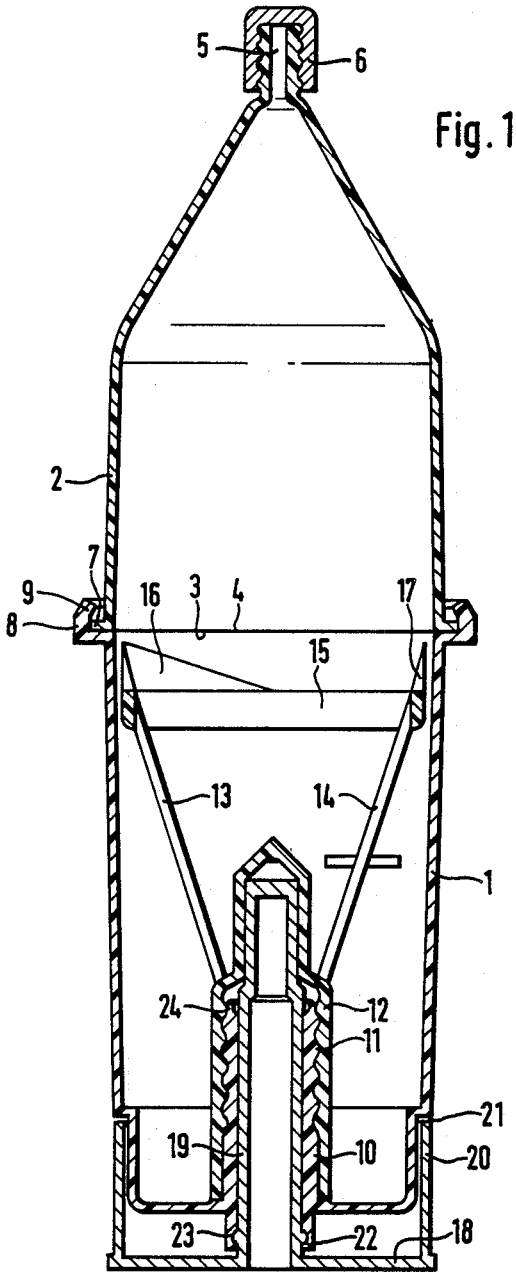
FIG. 1 a cross-sectional view of a first embodiment of a multi-compartment container according to the present invention.

The multiple-compartment container shown in FIG. 1 comprises a first container portion 1—henceforth called the lower portion—and a second container portion 2—henceforth called the upper portion. Both portions are produced from a plastic material in a manner known per se. The interior spaces of the container portions are separated from one another by means of foils 3, 4 and each container portion receives a substance. The upper portion 2 comprises a pouring opening 5 which can be closed by a locking cap. A circumferentially extending edge 7 is provided at the upper portion 2 for connecting the two container portions with one another, while the lower portion is provided with a snap ring 8 which slides along the circumferentially extending edge 7 of the upper portion 2 when the container portions are joined together. The snap ring radially deformed and contracts again as soon as the annular shoulder 9 has passed over the circumferentially extending edge 7.

A spindle 10, which is connected in one piece with the lower portion and comprises a coarse thread 11, is located at the base of the lower portion. A spindle nut 12, which likewise is made of a plastic material and comprises arms 13, 14, and whose ends carry a ring 15 provided with two cutting edges 16, 17, engages the spindle 10.

In order to rotate the spindle nut and accordingly simultaneously rotate and lift the cutting edges 16, 17, an activating device 18 is provided which comprises a peg 19 which is supported in an axial bore of the spindle 10. Moreover, the activating device is constructed as a ring 20 which can easily be grasped with one hand for the purpose of rotating, while the other hand holds the multiple-compartment container. The ring 20 encloses a portion of the lower portion which has a smaller radius. A circumferentially extending shoulder 21 is accordingly formed on which the ring 20 is supported. This and a corresponding construction of the lower edge of the ring 20, ensure that the multiple-compartment container stands securely.

In order to prevent the ring 20 from axial movement during its rotation, the rotationally locking connection between the peg 19 and the spindle nut 12 (e.g. in the form of a rectangle or hexagon) is constructed so as to be axially displaceable. In addition, the activating device 18 is secured against an axial displacement and against falling out, respectively, by a circumferentially extending flange 22 which engages a circumferentially extending groove 23. A sealing lip 24 seals the interior space of the lower portion 1 relative to the bore in the spindle.

The multiple-compartment container, according to the invention, is assembled and filled in the following manner. The device for severing the foil is inserted in the lower portion 1 wherein the spindle nut 12 is screwed onto the spindle 10. The activating device 18 is then inserted into the bore of the spindle 10 until it snaps in. The lower portion can then be filled and welded with a foil 3. The locking cap 6 is screwed onto the upper portion 2, whereupon the upper portion 2 is filled upside-down and welded with the foil 4. The two container portions are then pressed against one another so that the snap ring 8 snaps over the circumferentially extending edge 7.

In order to mix the two substances, the ring 20 is turned by somewhat more than one revolution relative to the lower portion 1, whereupon the cutting edges 16, 17 move upward along the outer wall of the lower portion 1. In so doing, the cutting edges penetrate into the foil and cut it circularly. The two substances are mixed by forceful shaking correspondingly constructed arms 13, 14 reinforce the mixing process. The rectangle or hexagon, respectively, is shorter than the thread 11, so that the spindle nut 12 remains on the spindle when the foils 3, 4 are severed. The device for severing the foil thus remains in place when the container is shaken. After detaching the locking cap 6, the mixture can be removed by lightly creasing the upside-down container.

Polypropylene or polystyrene are suitable material for the upper portion 2 and the activating device 18. The lower portion 1, which can be creased, can be produced from polyethylene. A different selection of materials adapted to the respective use is left to the person skilled in the art.

Figure 2:
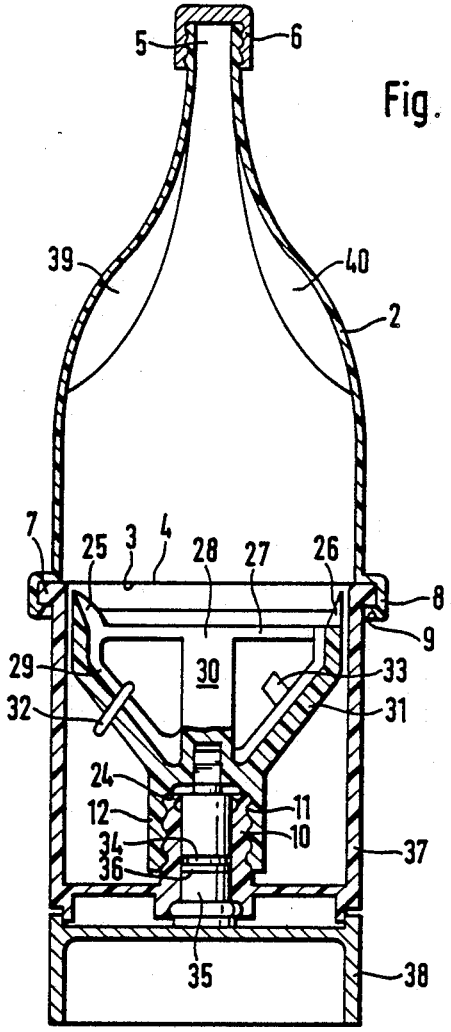
FIG. 2 a cross-sectional view of a second embodiment of a multi-compartment container according to the present invention.

In the embodiment shown in FIG. 2, the container portions and the activating device, per se, are constructed in a manner similar to the embodiment form according to FIG. 1. However, the upper portion 2 is constructed in such a way that it can be creased. The device for severing the foil also differs from the embodiment according to FIG. 1. Specifically, the cutting edges 25, 26 are arranged at a cutting ring member 27 which consists of a ring 28 and four arms, three of which arms 29, 30, 31 are shown. In order to improve the mixing process, the arms are provided with guide blades 32, 33. Moreover, another seal 36 is arranged in a circumferentially extending groove 34 of the peg 35.

The lower portion 37 and the ring 38 are constructed somewhat differently relative to the corresponding parts in the embodiment according to FIG. 1, which, however, essentially has only an aesthetic effect.

In addition, a plurality of ribs 39, 40 are provided at the inner wall of the upper portion 2 in the embodiment example according to FIG. 2. The cut out foil is accordingly prevented from covering the pouring opening 5 and accordingly impeding an emptying of the container. In FIG. 2, only two ribs are shown; the quantity and the shape of the ribs in particular can be selected within the framework of the choices available to the person skilled in the art.

While the invention has been illustrated and described with reference to specific embodiments, it is not intended to e limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A multiple compartment container for pourable substances, particularly liquids, comprising first and second container portions each having an interior space; at least one foil for separating said first and second container portions; means for severing said foil; a spindle located in said first container portion for rotatably supporting said severing means; and rotatable activating means connected with said severing means for joint rotation therewith, said spindle comprising an axially extending bore, and said activating means comprising a pivot received in said axially extending bore and having an end facing the interior space of said first container portion, said end being formed as a driver for said severing means, said axially extending bore comprising a circumferentially extending groove, and said pivot comprising a circumferentially extending flange cooperating with said circumferentially extending groove to form an axial protection for said activating means.

2. A container according to claim 1, wherein said activating means is secured against axial displacement and said severing means is axially displaceable relative to said activating means.

3. A container according to claim 1, wherein said activating means includes an annular portion.

4. A container according to claim 3, wherein said annular portion is constructed as an upright ring partially enclosing said first container portion.

5. A container according to claim 1, wherein said spindle has a free end formed as a sealing lip.

6. A container according to claim 1, wherein said spindle comprises a coarse thread.

7. A container according to claim 1, wherein said severing means comprises a spindle nut and at least one arm extending in radial and axial directions, said arm having opposite end s and said arm being attached to said spindle nut at one of said opposite ends and having a cutting edge at the other of said opposite ends.

8. A container according to claim 7, wherein said severing means comprises a plurality of arm shaving opposite ends respectively, said arms being connected to said spindle nut at one of said opposite end sand having cutting edges at the other of said opposite ends, respectively, said opposite ends having said cutting edges being connected with each other in a ring-shaped manner.

9. A container according to claim 1, wherein each of said first and second portion is filled with a substance, said severing means comprising means for improving mixing of the substances, said improving means comprising guide blades.

10. A container according to claim 1, wherein said first and second container portions have opposite surfaces respectively closed by said foil, one of said first and second container portions having a circumferentially extending edge and the other of said first and second container portions being provided with a snap ring grasping said circumferentially extending edge.

11. A container according to claim 1, wherein said first container portion is creased.

12. A container according to claim 1, wherein said second container portion comprises a pouring opening and has an inner wall having ribs thereon at least in the area of said pouring opening.

* * * * *